US005299781A

United States Patent [19]

Barrett et al.

[11] Patent Number: 5,299,781

[45] Date of Patent: Apr. 5, 1994

[54] FLEX POST FENCE

[75] Inventors: Robert K. Barrett, Grand Junction; George Hearn, Boulder; Michael L. McMullen, Denver, all of Colo.

[73] Assignee: State Department of Highways, State of Colorado, Denver, Colo.

[21] Appl. No.: 727,863

[22] Filed: Jul. 10, 1991

[51] Int. Cl.[5] ..... E01F 7/04

[52] U.S. Cl. ..... 256/12.5; 256/13.1; 256/1; 52/169.2

[58] Field of Search ..... 256/12.5, 13.1, DIG. 6, 256/1; 52/169.9, 169.2, 169.3, 169.4, 298, 296; 40/608; 404/10, 11

[56] References Cited

U.S. PATENT DOCUMENTS

| | | | |
|---|---|---|---|
| 3,966,172 | 6/1976 | Garrett | 256/12.5 |
| 4,339,114 | 7/1982 | Deike | 256/12.5 |
| 4,730,810 | 3/1988 | Rambaud . | |
| 4,819,915 | 4/1989 | Cargnel . | |

FOREIGN PATENT DOCUMENTS

| | | | |
|---|---|---|---|
| 0390965 | 10/1990 | European Pat. Off. | 256/12.5 |
| 1459804 | 5/1969 | Fed. Rep. of Germany . | |
| 1658696 | 11/1970 | Fed. Rep. of Germany | 256/12.5 |
| 3938323 | 6/1990 | Fed. Rep. of Germany | 256/12.5 |
| 2414586 | 8/1979 | France . | |
| 580285 | 7/1958 | Italy | 256/12.5 |
| 656659 | 7/1986 | Switzerland . | |
| 672157 | 10/1989 | Switzerland . | |
| 2067629 | 7/1981 | United Kingdom | 256/13.1 |

*Primary Examiner*—Randolph A. Reese
*Assistant Examiner*—Harry C. Kim
*Attorney, Agent, or Firm*—Fields, Lewis, Pittenger & Rost

[57] ABSTRACT

A boulder rolling down a slope is caught with an energy absorbing device to dissipate a portion of its kinetic energy and to redirect the boulder downwardly into the ground to absorb the rest of the kinetic energy and to stop it. This is accomplished by temporary deformation of joints in the energy absorbing device to dissipate the kinetic energy and redirect the boulder downwardly into the ground. The energy absorbing device will return substantially to its undeformed state for intercepting additional boulders which may roll down the slope.

11 Claims, 4 Drawing Sheets

FLEX POST FENCE

TECHNICAL FIELD

This invention relates to a fence construction, and particularly a fence construction for dissipating the energy from boulders rolling down a slope on a hill or mountain to minimize the possibility of the boulders falling onto roadways and other undesirable areas.

BACKGROUND ART

Long steep slopes on hills and mountains present a continuing danger that loose rocks or boulders may roll onto roadways or other public areas causing injury to individuals and equipment in the area. These boulders are often dislodged during rainstorms or other inclement weather causing them to roll down the slope at high velocity with the potential of causing severe injury to persons and damage to anything they may hit.

Various attempts to minimize the possibility of the boulders intruding upon roadways and other public areas have been attempted. Rigid fences or barriers have been constructed, but because of the great force created by the boulders as they pick up speed rolling down the hill, they often crash through the rigid fences or barriers and continue their path down the slope.

Attempts have been made to design flexible fence barriers which work in combination with cables to give away when impacted by the boulders. Examples of the developments in this technology are French Patent No. 2,414,586; Swiss Patent No. 656,659; Swiss Patent No. 672,157 and U.S. Pat. No. 4,730,810 to Rambaud. Also, U.S. Pat. No. 4,819,915 to Cargnel discloses a flexible barrier wherein vertical posts are pivotally mounted and normally held in an upright position by means of cables. Upon impact of the barriers with rocks, the posts will pivot, this pivoting motion being resisted by the cables. The fence sections may be provided with cross cables to resist the impact of a rock or other load hitting the fence as shown in German Patent No. 1,459,804.

While each of the foregoing prior art devices is suitable for its intended purpose, the structures are complicated and therefore excessively expensive and have not met with wide scale acceptance. Also, those that have pivotal posts are only good for one time use. That is, once the posts have pivoted over, they stay in that position until they are reset in an upright position and the supporting cables are readjusted to hold them.

DISCLOSURE OF THE INVENTION

In its broadest aspects, the present invention involves catching a boulder rolling down a slope with an energy absorbing device to dissipate a portion of its kinetic energy and to redirect the boulder downwardly into the ground to absorb the rest of the kinetic energy and to stop it. This is accomplished by temporary deformation of the energy absorbing device to dissipate the kinetic energy and redirect the boulder downwardly into the ground. The energy absorbing device then will return to substantially its undeformed state and will move the boulder up the slope beyond the energy absorbing device if it is not too heavy.

More particularly, the invention contemplates a pair of spaced posts mountable and upright position on the side of a slope, each post having a flexible energy absorbing joint just above the ground level. A flexible barrier, having upper and lower edges, extends between the posts and is normally supported in an upright position. The posts are bendable about the joints upon impact of the barrier by a boulder as it moves down the slope. This causes the barrier to tip in a downwardly direction changing the direction of movement of the boulder so that it impacts the ground causing its kinetic energy to be dissipated. Each of the posts includes a lower section anchorable in the ground and an upper section spaced from the lower section and connected thereto by the joint. The joint has a lower end extendable into the lower section and an upper end extendable into the upper section and means for securing the respective ends of the joint in the respective post sections. Conveniently, the joint can comprise a bundle of resilient cables and the securing means can be a cementitious material for filling voids between the cables and between the cables and the side walls of the respective post sections. After the joint is bent due to the impact of a boulder against the barrier, it will tend to spring back to return the posts to an upright position so that the barrier is in position to intercept additional boulders that may roll down the slope.

Additionally, a first cable can be provided which is wrappable around the top of the lower section of one of the pair of posts and the top of the upper section of the other of the pair of posts. A second cable is wrappable around the top of the upper section of the one of the pairs of posts and the top of the lower section of the other of pair of posts so that the cables crisscross the flexible barrier. Means is provided for securing the cables at the upper ends of the lower posts and the upper ends of the upper posts. The securing means can comprise a pair of spaced bolts extending outwardly through at least one side wall of each of the posts and a plate secured to the bolts on the other side of the post section for clamping each of the cables therebetween.

The fence can comprise many posts. For example, it can include a pair of end posts with a plurality of intermediate posts spaced therebetween, with the cables extending in zig-zag fashion across all of the posts. In addition, an upper cable can extend across the upper edge of the barrier and extend between the bolts and the upper end of the upper sections and a lower cable can extend along the lower edge of the barrier from one end post to the other and held loosely against the upper ends of the lower section of each of the intermediate posts by a loop member extending around the upper end of the lower section of each intermediate post.

From the foregoing, the advantages of this invention are readily apparent. A method and apparatus have been provided for dissipating and redirecting the kinetic energy of a boulder rolling down a slope and into the ground to fully dissipate its kinetic energy.

Additional advantages of this invention will become apparent from the description which follows, taken in conjunction with the accompanying drawings.

BEST MODE FOR CARRYING OUT THE INVENTION

Figure 1:
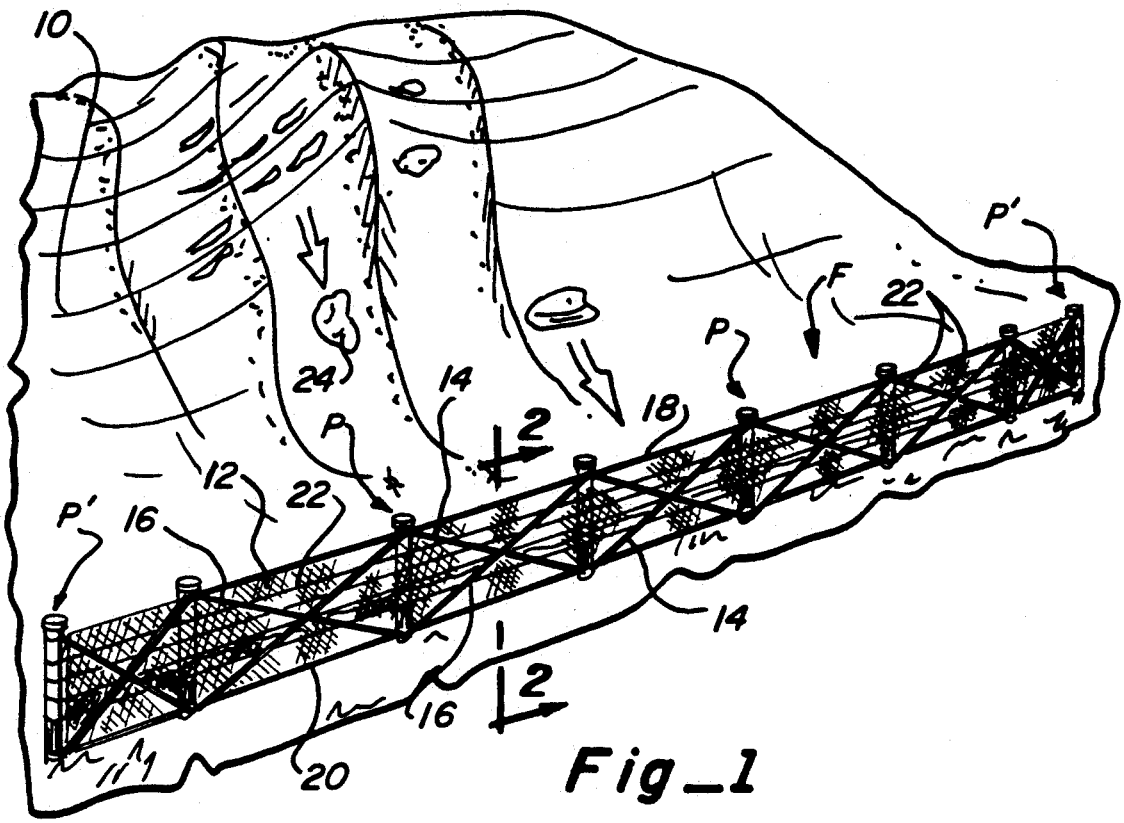
FIG. 1 is a perspective view showing a barrier constructed in accordance with this invention on the side of a slope.

In accordance with this invention, a fence F is provided along the slope 10 of a hill or mountainside. The fence has equally spaced intermediate posts P and terminates at end posts P' which are spaced a lesser distance from the outside intermediate posts but otherwise have the same construction as posts P, described below. A flexible barrier 12 extends between the posts and is attached thereto, as described below. Also, cables 14 and 16 extend across the sections of flexible barrier 12 between each pair of posts in diagonal or zig-zag fashion, as shown. In addition, an upper cable 18 extends across the upper edge of flexible barrier 12 between the intermediate posts and a lower cable 20 extends along the bottom edge of flexible barrier 12 from end post to end post. The manner in which the flexible barrier 12, the intermediate post P, the end post P' and the various cables are interconnected will be fully explained below. Finally, a plurality of horizontal rows of intermediate cables 22 extend across flexible barrier 12 from end post to end post.

Figure 2:
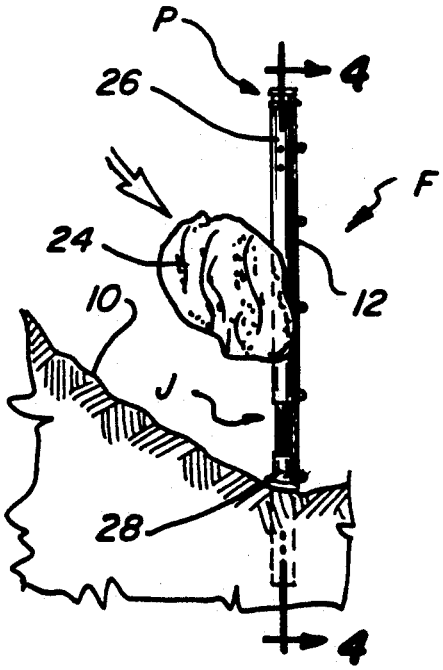
FIG. 2 is an enlarged vertical section, taken along line 2—2 of FIG. 1, showing a boulder as it impacts the barrier.
Figure 3:
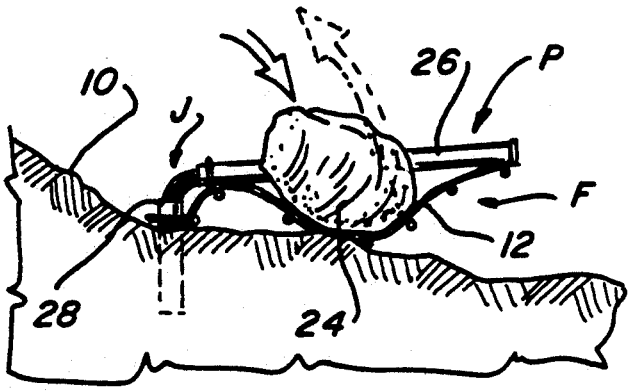
FIG. 3 is a section similar to FIG. 2, but showing the position of the barrier after impact by the boulder.

As a loosened boulder 24 comes rolling down the slope, it will strike against flexible barrier 12 of fence F. The posts P comprise an upper section 26 and a lower section 28 interconnected by a flexible joint J. The kinetic energy will be absorbed by the flexible barrier and bending of the joint J as the fence is forced to pivot in a clockwise direction, as viewed in FIGS. 2 and 3. Some of the kinetic energy of boulder 24 will be absorbed by the structure during this bending movement. In addition, the fence F will redirect the boulder in a downward direction wherein it is directed into the ground thereby dissipating the remainder of its kinetic energy. If the boulder is not too heavy, the fence will spring back toward an upright position due to the resilience of joint J causing the boulder to be moved to a position just up slope of fence F which will retain the boulder thereafter for an indefinite period.

Figure 4:
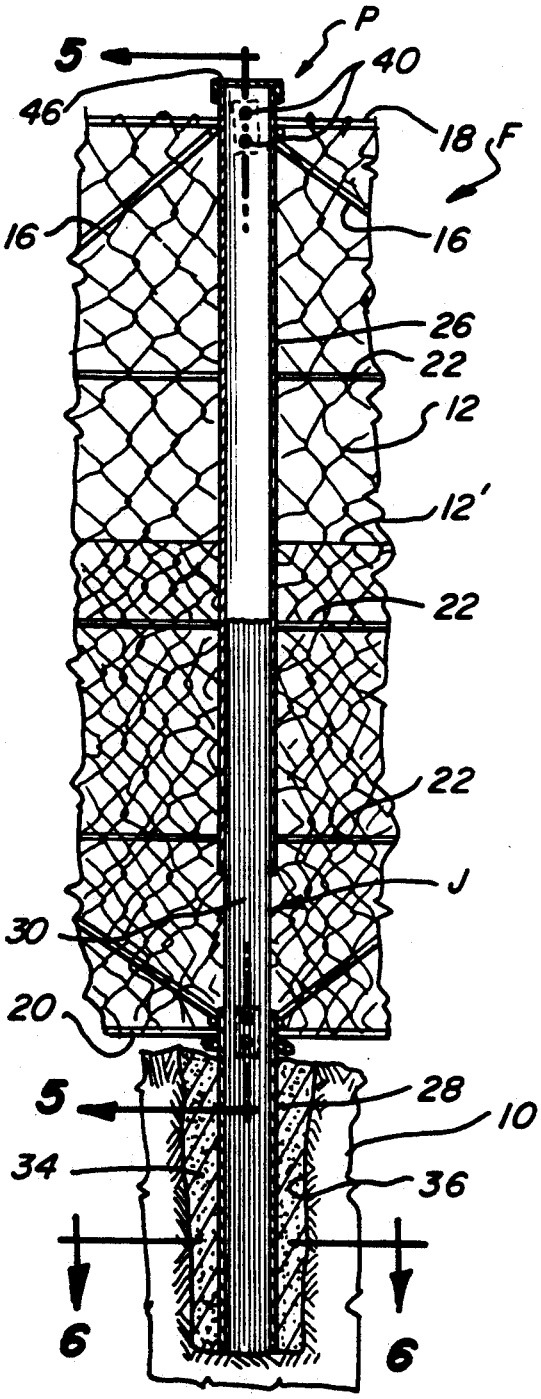
FIG. 4 is an enlarged vertical section, taken along line 4—4 of FIG. 2, of one of the posts for the barrier.
Figure 5:
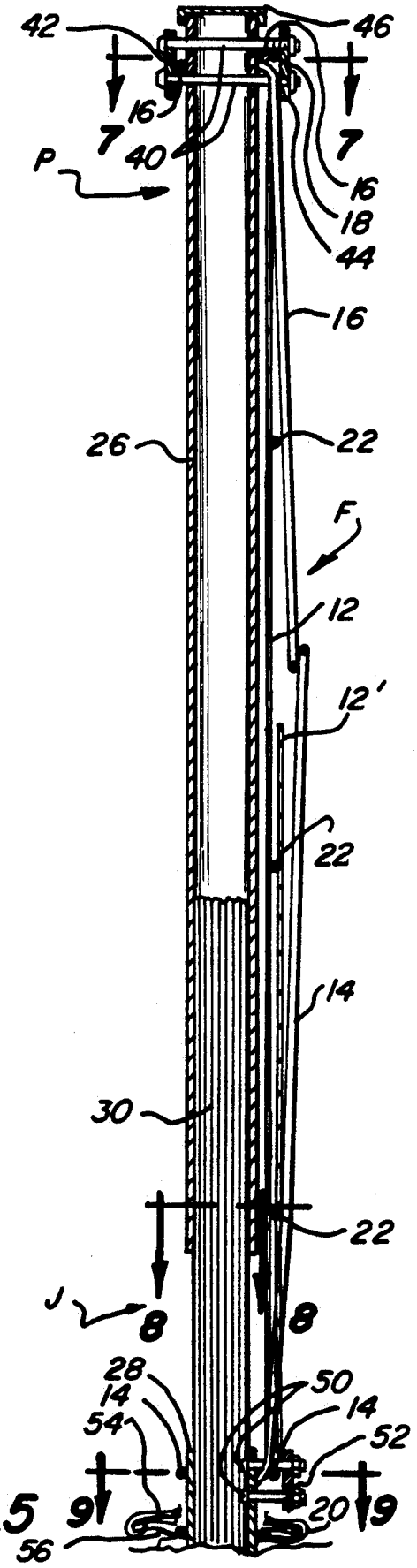
FIG. 5 is an enlarged vertical section, taken along line 5—5 of FIG. 4, showing further details of the posts and the interconnections with the barrier.
Figure 6:
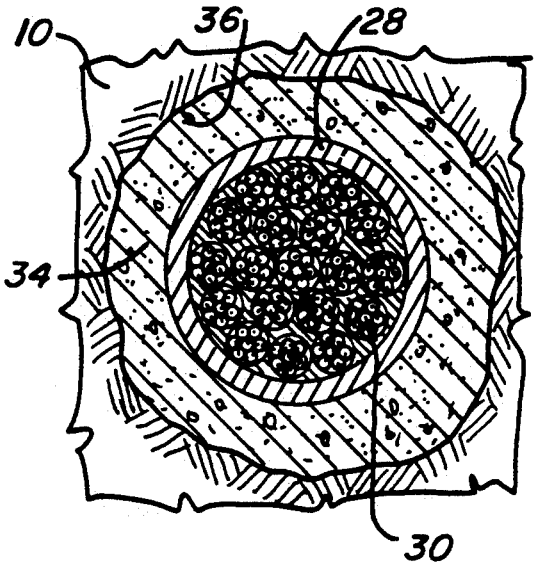
FIG. 6 is an enlarged horizontal section, taken along line 6—6 of FIG. 4, showing details of the lower section of the posts.
Figure 8:
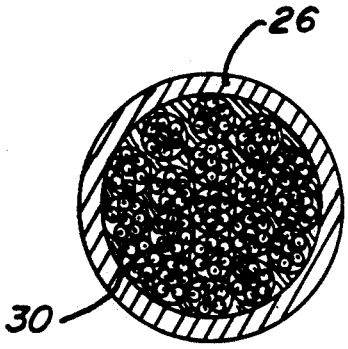
FIG. 8 is an enlarged horizontal section, taken along line 8—8 of FIG. 5, showing further details of the post construction.

As best seen in FIGS. 4 and 5, the upper section 26 and lower section 28 of each post P comprises a tubular member. The joint J comprises a bundle 30 of resilient bendable cable strands, the upper end of the bundle being inserted in the lower end of upper section 26 and the lower or bottom end of bundle 30 being inserted into the lower section and extending substantially the full length thereof. Conveniently, nineteen cables are used and each cable is a seven wire strand cable ASTM-A416. Each cable has a tensile strength of 270,000 pounds per square inch. These cables are normally used for ground anchors and to stress bridges. They are sold under the trade name "Polystrand" by Lang Tendons, Inc., 143 North Newark Road, Toughkenamon, Pa. 19374. The cable bundles are held in both the upper and the lower sections by use of a grout 32 such as Celroc 10-34 manufactured by Celtite, Inc., 150 Carley Court, Georgetown, Ky. 40324. This grout will harden to 7,000 psi in forty-eight hours. Conveniently, lower section 28 is secured in the ground of slope 10 by means of concrete 34 poured in a hole 36 into which post P has been placed. It can be seen that when the barrier 12 or one of the posts P is struck by a boulder, the posts can bend about joint J by bending cable bundles 30. Because of the resilience of its construction and the memory of the cables of bundles 30, once the kinetic energy of the boulder has been dissipated, the posts will tend to upright themselves so as to return to the vertical unstressed position of joint J so that the barrier is positioned to intercept additional boulders that may roll down the slope.

Figure 7:
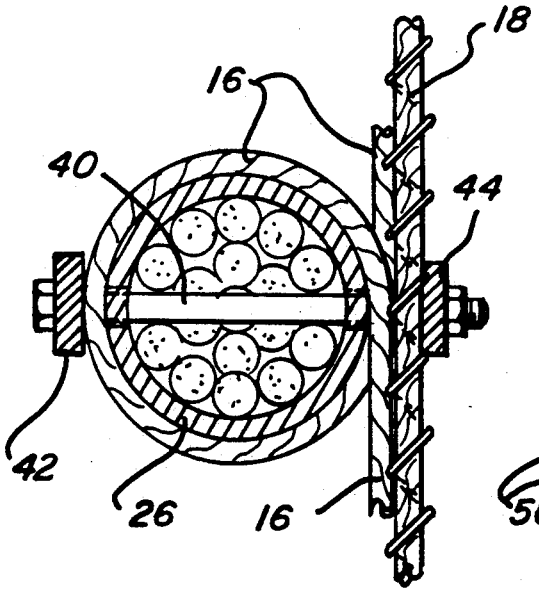
FIG. 7 is an enlarged horizontal section, taken along line 7—7 of FIG. 5, showing the interconnections at the top of the posts.

As best seen FIGS. 4, 5 and 7, a pair of bolts 40 extend through upper section 26 at post P and serve to clamp a first plate 42 on the uphill side of the post and a second plate 44 on the downhill side of the post. Conveniently, cable 16 is wrapped around the upper end of the post section 26 between spaced bolts 40 and plates 42 and 44 so as to be clamped therebetween when the bolts are tightened down. Also, upper cable 18 passes between the downhill side of upper section 26 and plate 44 and is held in clamped position. On the next adjacent intermediate post, cable 14 is wrapped around the upper end in a similar manner is cable 16 on the post illustrated. The upper section 26 can be provided with a cap 46 attached, as by threads as shown.

Figure 9:
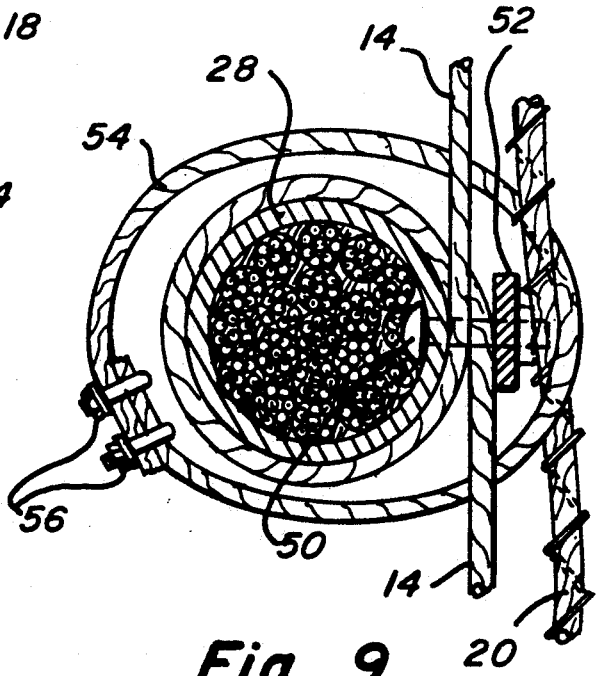
FIG. 9 is an enlarged horizontal section, taken along line 9—9 of FIG. 5, showing details of the connections at the bottom of the post.

As best seen in FIGS. 5 and 9, a pair of spaced bolts 50 extend through the downhill side wall of lower section 28, through which cable 14 extends and wraps around the upper portion of lower section 28 and is clamped thereagainst by plate 52. In addition, lower cable 18 is held loosely against the bottom of post P by a cable loop 54 whose ends are interconnected by brackets 56. Of course, on the next adjacent intermediate post P, cable 16 would be wrapped around the top of lower section 28.

Figure 10:
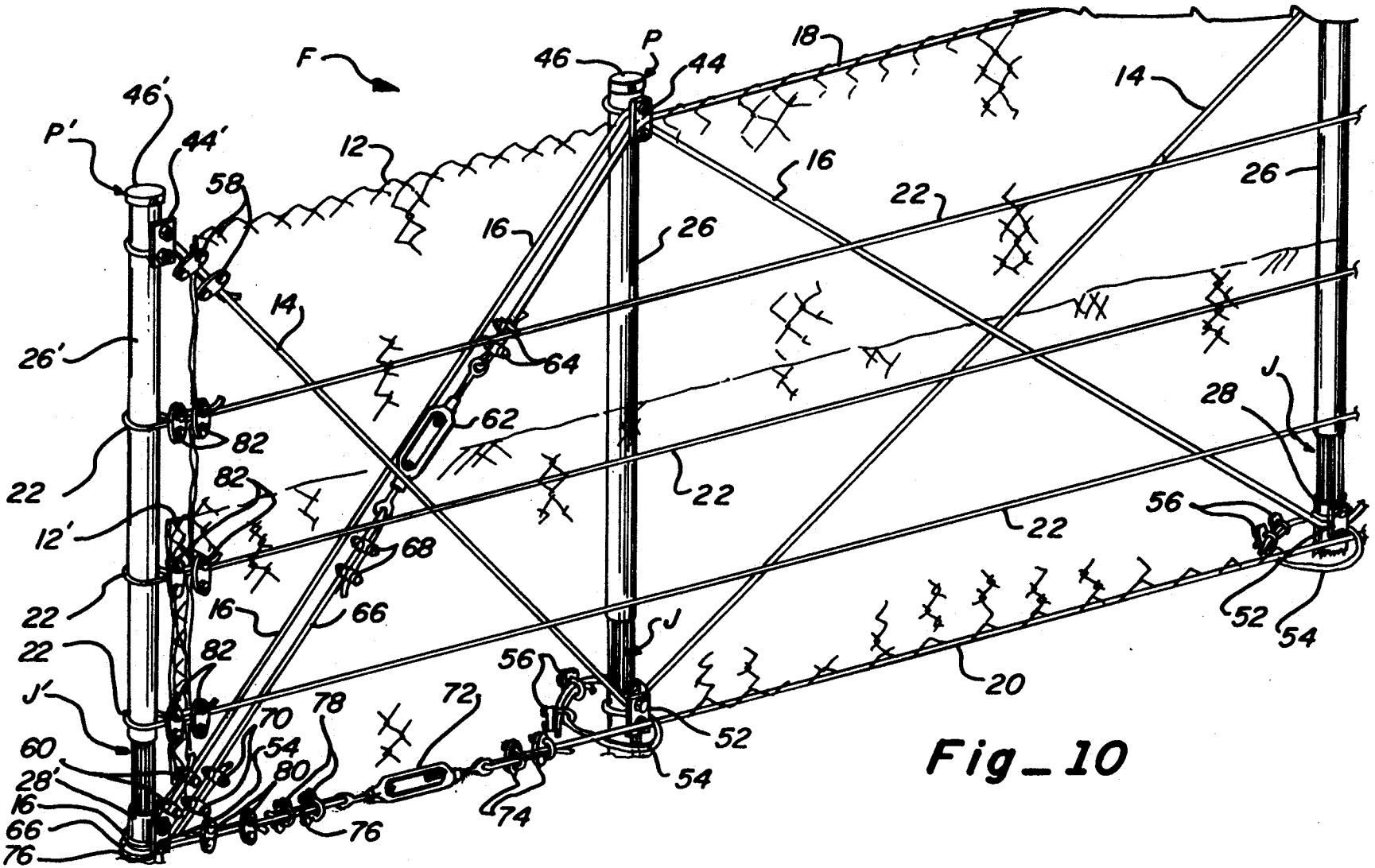
FIG. 10 is an enlarged perspective view of an end section and an intermediate section of the barrier showing the overall construction thereof.

Turning to FIG. 10, the end of cable 14 is wrapped around the upper end of section 26' of post P' and is held by a pair of clamps 58 as shown. Similarly, the end of cable 16 extends around the upper end of lower portion 28' of post P' and is held by clamps 60. Upper section 26' is connected to lower section 28' by joint J'. Post P' also has a cap 46' on top of upper section 28'. Upper cable 18 is tensioned by turn-buckle 62 to which it is attached at one end by brackets 64. The other end of the turn buckle 62 is attached to a short cable 66 by brackets 68. The end of cable 66 extends around the lower section 28' and is held by brackets 70. Similarly, the end of lower cable 20 is connected to a turn-buckle 72 by brackets 74. The other end of the turn-buckle is connected to a short cable 76 by brackets 78. The end of short cable 76 extends around lower portion 28' and is held by a pair of spaced brackets 80. The end of each of intermediate cables 22 wraps around end post P' and each is held in place by a pair of brackets 82, as shown.

A second, shorter flexible barrier 12' can be provided across the lower portion of barrier 12 to provide added strength to resist the impact of boulders striking the lower portion of the fence.

From the foregoing, it can been seen that a fence barrier has been provided which is of relatively simple and inexpensive construction, but is capable of dissipating kinetic energy from a boulder rolling down a slope and redirecting that boulder into the ground to dissipate the remainder of its kinetic energy. This is accomplished by means of flexible energy-absorbing joints at the bottom of the posts supporting the fence which can bend forwardly when the fence is impacted by a boulder and then spring backward to an upright position after the kinetic energy of the boulder has been fully dissipated to position the fence to intercept additional boulders that subsequently that may roll down the slope.

This invention has been described in detail with reference to a particular embodiment thereof, but it will be understood that various other modifications can be effected within the spirit and scope of this invention.

We claim:

1. A method of dissipating the kinetic energy of a boulder rolling down a slope comprising the steps of:

catching the boulder with an energy absorbing device to dissipate a portion of its kinetic energy as it moved down the slope wherein said device experiences temporary deformation to dissipate said kinetic energy;

redirecting the bounder downwardly into the ground to absorb the rest of the kinetic energy to stop the downward movement of the boulder;

moving the boulder up the slope, after its kinetic energy has been dissipated, to a position uphill of the energy absorbing device.

2. A method, as claimed in claim 1, including the further step of:

returning the energy absorbing device substantially to its undeformed state while moving the boulder up the slope beyond the energy absorbing device.

3. A fence for serving as a barrier for dissipating the kinetic energy of boulders rolling down a slope, said barrier comprising:

at least one pair of posts mountable in upright spaced positions on the side of the slope wherein said posts serve as single anchor points for securing said barrier to said slope, and each has a lower tubular section anchorable in the ground and an upper tubular section spaced from said lower section and connected thereto;

a flexible barrier, having upper and lower edges, extendable between said upper tubular sections and normally supported in upright position thereby, said barrier being continuous between said pair of posts;

a resilient flexible joint interconnecting said lower tubular section and said upper tubular section, said joint having a lower end extendable into the entire length of said lower section and an upper end extendable into said upper section;

means for securing said ends of said joint in said respective post sections, said posts being bendable about said joints upon impact by a boulder against said barrier as the boulder moves down the slope to tip said barrier in a down-slope direction changing the direction of movement of the boulder so that it impacts the ground causing its kinetic energy to be dissipated, said joints springing back after the kinetic energy of the boulder has been dissipated to return said posts to a substantially upright position such that said barrier when impacted by the boulder bends as one unitary whole anchored only at said posts and to reposition said barrier to intercept additional boulders which may roll down the slope, said joint comprises a bundle of cables;

a first cable wrappable around the top of said lower section of one of said pair of posts and the top of said upper section of the other of said pair of posts; and a second cable wrappable around the top of said upper section of said one of said pair of posts and the top of said lower section of the other of said pair of posts so that said cables criss-cross over said flexible barrier.

4. Apparatus, as claimed in claim 3, wherein said securing means comprises:

a cementitious material for filling voids between said cables and between said cables and inside of said respective upper and lower tubular sections.

5. A fence for serving as a barrier for dissipating the kinetic energy of boulders rolling down a slope, said barrier comprising:

at least one pair of posts mountable in upright spaced positions on the side of the slope wherein said posts serve as single anchor points for securing said barrier to said slope, and each has a lower tubular section anchorable in the ground and an upper tubular section spaced from said lower section and connected thereto;

a flexible barrier, having upper and lower edges, extendable between said upper tubular sections and normally supported in upright position thereby, said barrier being continuous between said pair of posts;

a resilient flexible joint interconnecting said lower tubular section and said upper tubular section, said posts being bendable about said joints upon impact by a boulder against said barrier as the boulder moves down the slope to tip said barrier in a down-slope direction changing the direction of movement of the boulder so that it impacts the ground causing its kinetic energy to be dissipated, said joints springing back after the kinetic energy of the boulder has been dissipated to return said posts to a substantially upright position such that said barrier when impacted by the boulder bends as one unitary whole anchored only at said posts and to reposition said barrier to intercept additional boulders which may roll down the slope;

a first cable wrappable around the top of said lower section of one of said pair of posts and the top of said upper section of the other of said pair of posts; and a second cable wrappable around the top of said upper section of said one of said pair of posts and the top of said lower section of the other of said pair of posts so that said cables criss-cross over said flexible barrier; and means for rigidly securing said cables at the upper ends of said lower post sections and said upper ends of said upper post sections such that said cables are restricted from freedom of movement at point of attachment to said posts, said securing means including:

a pair of spaced bolts extending outwardly through at least one side of wall of each of said post sections; and a first plate secured to said bolts on one side of each of said post sections; and a holding nut secured to said first plate on each of said post sections, said cables being wrappable around said posts and crossing over themselves between said first plate and said securing nut to hold said cables against said posts without slippage or freedom of movement.

6. Apparatus, as claimed in claim 5, further including:

a second plate secured to said bolts on the opposite side of each of said post sections to hold said cables against said posts without slippage or freedom of movement.

7. A fence for serving as a barrier for dissipating the kinetic energy of boulders rolling down a slope, said fence comprising:

a pair of end posts mounted in an upright position on the side of the slope spaced from each other a distance equal to the length of said fence;

a plurality of intermediate spaced posts mounted in an upright position on the side of the slope between said end posts wherein said end posts and said intermediate posts each has a lower tubular section having an upper end and a lower end achorable in the ground, an upper tubular section, having an upper end and a lower end, spaced from said lower section and connected thereto, said end posts and said intermediate posts operating as sole anchor points for securing said fence to said slope;

a flexible barrier, having upper and lower edges, extending between and attached to each of said end posts and said intermediate posts and normally supported in an upright position thereby said barrier being continuous between said end posts and said intermediate posts;

a resilient flexible joint in each of said end posts and said intermediate posts just above ground level, said joint having a lower end extendable into said lower section and an upper end extendable into said upper section and means for securing said ends of said joint in said respective post sections, said posts being bendable about said joints upon impact by a boulder against said barrier as the boulder moves down the slope to tip said barrier in a down-slope direction changing the direction of movement of the boulder so that it impacts the ground causing its kinetic energy to be dissipated, said joints springing back after the kinetic energy of the boulder has been dissipated to return said end posts and said intermediate posts to a substantially upright position such that said barrier when impacted by the boulder bends as one unitary whole anchored only at said posts and to reposition said barrier to intercept additional boulders which may roll down the slope;

a first cable extending across said barrier in diagonal zig-zag fashion having a first end connected to said upper end of said upper section of one of said end posts, and extends to and is attached to said upper end of said lower section of the adjacent intermediate post and then extends to and is attached to said upper end of said upper section of the next intermediate post and so on and having a second end thereof connected to said upper end of one of said upper and lower sections of said other end post; and a second cable extending across said barrier in zig-zag fashion and in criss-crossing relationship with said first cable, having a first end connected to said upper end of said lower section, and extends diagonally to and is attached to said upper end of said upper section of said adjacent intermediate post and then extends diagonally to and is attached to said upper end of said lower section of said next intermediate post and so on and having a second end thereof connected to said upper end of said other of said upper and lower sections of said other end post.

8. Apparatus, as claimed in claim 7, wherein:

said joint comprises a bundle of cables; and a cementitious material for filling voids between said cables and between said cables and inside of said respective upper and lower tubular sections.

9. Apparatus, as claimed in claim 7, wherein said cables are attached to said respective upper ends of said upper and lower sections of said intermediate posts by being wrapped therearound and further including:

means clamping said cables to said respective upper and lower post sections.

10. Apparatus, as claimed in claim 9, wherein said clamping means includes:

a pair of spaced bolts extending through one side of said upper section adjacent said upper end of each of said upper and lower sections, said cables respectively being wrapped around said sections and crossing over themselves between said bolts;

a lock plate received over said bolts with said crossed cable therebetween; and locking nuts on the ends of said bolts pressing said locking plate against said crossed cable to hold it in place between said locking plate and said tubular wall.

11. Apparatus, as claimed in claim 10, further including:

an upper cable extending across said upper edge of said barrier and extending between said bolts at said upper end of said upper sections, said upper cable having first and second ends connected to said upper ends of said lower sections of said respective end posts so as to extend diagonally across the portion of said barrier between said end posts and said first adjacent intermediate post;

a lower cable extending along said lower edge of said barrier from one said end post to said other end post, connected thereto and held loosely against said upper end of said lower section of each said intermediate post by a loop member extending around each said intermediate post; and a plurality of interior horizontal cables extending along said barrier and between said upper cable and said lower cable, said interior cables having first and second ends connected to said upper sections of said respective end posts.

* * * * *

UNITED STATES PATENT AND TRADEMARK OFFICE

CERTIFICATE OF CORRECTION

PATENT NO. : 5,299,781

DATED : April 5, 1994

INVENTOR(S) : Robert K. Barrett et al.

It is certified that error appears in the above-identified patent and that said Letters Patent is hereby corrected as shown below:

Column 5, Line 27, delete "bounder" and insert --boulder--.

Signed and Sealed this

Sixth Day of September, 1994

*Attest:*

*Attesting Officer*

BRUCE LEHMAN

*Commissioner of Patents and Trademarks*